US005195442A

United States Patent [19]

Meier

[11] Patent Number: 5,195,442

[45] Date of Patent: Mar. 23, 1993

[54] PROCESS AND SEWING MACHINE FOR PRODUCING SEWING PATTERNS

[75] Inventor: Willi Meier, Karlsruhe-Durlach, Fed. Rep. of Germany

[73] Assignee: PFAFF Haushaltsmaschinen GmbH, Karlsruhne, Fed. Rep. of Germany

[21] Appl. No.: 751,745

[22] Filed: Aug. 29, 1991

[30] Foreign Application Priority Data

Aug. 30, 1990 [DE] Fed. Rep. of Germany ..... 4027364

[51] Int. Cl.[5] ..... D05B 3/02; D05B 27/00

[52] U.S. Cl. ..... 112/266.1; 112/454

[58] Field of Search ..... 112/454, 456, 457, 458, 112/453, 266.1, 308, 121.12, 103, 262.3

[56] References Cited

U.S. PATENT DOCUMENTS 4,187,794 2/1980 Ross et al. ..... 112/308
4,599,959 7/1986 Sano et al. ..... 112/458 X
4,607,585 8/1986 Meier ..... 112/454
4,622,907 11/1986 Kimura ..... 112/454 X
5,063,867 11/1991 Horie ..... 112/443

*Primary Examiner*—Peter Nerbun
*Attorney, Agent, or Firm*—McGlew and Tuttle

[57] ABSTRACT

In a process for producing combination patterns consisting of a plurality of individual sewing patterns by means of an electronically controlled sewing machine, which has a memory for the greatly different individual sewing patterns as well as for a plurality of individual stitches with different feed directions, wherein at least one individual stitch is prepared in a selectable manner between the formation of a last needle touchdown of a first individual sewing pattern and the formation of a first needle touchdown of a second individual sewing pattern. The fabric being sewn is fed at least partially at right angles to the normal feed direction or both in the normal feed direction and at right angles to this normal feed direction for a predeterminable number of individual stitches in order to produce a combination pattern of increased width.

7 Claims, 3 Drawing Sheets

PROCESS AND SEWING MACHINE FOR PRODUCING SEWING PATTERNS

FIELD OF THE INVENTION

The present invention pertains to a process for producing combination patterns consisting of a plurality of individual sewing patterns by means of an electronically controlled sewing machine including a memory storing greatly different individual sewing patterns as well as a plurality of individual stitches with different feed directions and to a sewing machine for carrying out the process.

BACKGROUND OF THE INVENTION

West German Patent Specification No. DE-PS 32,25,078 (corresponding to U.S. Pat. No. 4,607,585) discloses an electronically controlled sewing machine which has a random access memory (RAM), in which various access data of individual patterns stored in a read-only memory (ROM) of the sewing machine can be stored in different sequences in order to enable these sewing patterns to be sewn in this sequence. Using this sewing machine, it is possible to carry out a sewing process in which one or several forward or reverse stitches, which are also available in the read-only memory, can be inserted between two consecutive individual sewing patterns in order to thus produce new pattern structures deviating from the existing individual sewing patterns. Only combination patterns whose width is limited essentially to the width of the largest possible format of the individual sewing pattern being stored can be produced with the prior-art sewing machine and the process described. In contrast, broader sewing pattern combinations can be achieved only by repeated parallel sewing of the combination pattern set, which not only requires a considerable effort, but also leads to a displacement of the patterns sewn next to one another due to differences in the feed characteristics of the sewing machine and inaccurate guiding by the sewing machine operator.

SUMMARY AND OBJECTS OF THE INVENTION

It is an object of the present invention to produce combination patterns in a simple manner, whose width is not subject, in principle, to any limitations, from the existing individual sewing patterns.

According to the invention, a process is provided for producing combination patterns including providing an electronically controlled sewing machine with a memory and storing greatly different individual sewing patterns in the memory as well as a plurality of individual stitches with different feed directions. At least one of the individual stitches is inserted in a selectable manner between the formation of a last needle touchdown of a first individual sewing pattern and a formation of a first needle touchdown of a second individual sewing pattern. The fabric to be sewn is fed at least partially at right angles to a normal feed direction for a predeterminable number of individual stitches to prepare a combination pattern of increased width.

The electronically controlled sewing machine memory includes a read-only memory and a programmable working memory such as a random access memory. The initial address of a selectable number of stored individual sewing patterns can be consecutively stored by actuating a program entry key using a microprocessor for consecutively reading the individual sewing patterns associated with the initial address from the read-only memory to the working memory. The sewing machine includes a stitch forming arrangement including a needle and a feed mechanism with a feed dog. A stitch forming controlling device is provided for controlling the stitch forming arrangement. The stitch forming controlling device includes a first stepping motor controlling a lateral deflection of the needle bar rocker, a second stepping motor controlling a forward and reverse movement of the feed dog (in the normal direction), and another stepping motor controlling a lateral movement of the feed dog (at right angles to the normal direction). The control acts as means for producing combination patterns in which the width of the individual sewing patterns can be controlled essentially by a deflection of the needle and the length of the individual sewing patterns can be controlled by the movement of the feed dog in the normal feed direction, and the offset of the individual sewing patterns can be controlled by a combination of the movement of the feed dog in the normal feed direction and in the direction at right angles to the normal feed direction.

It is thus possible, in a simple manner, to produce new combination patterns or border patterns whose width depends only on the wishes of the sewing machine operator or the width of the fabric to be processed from the existing individual sewing patterns having a limited width.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
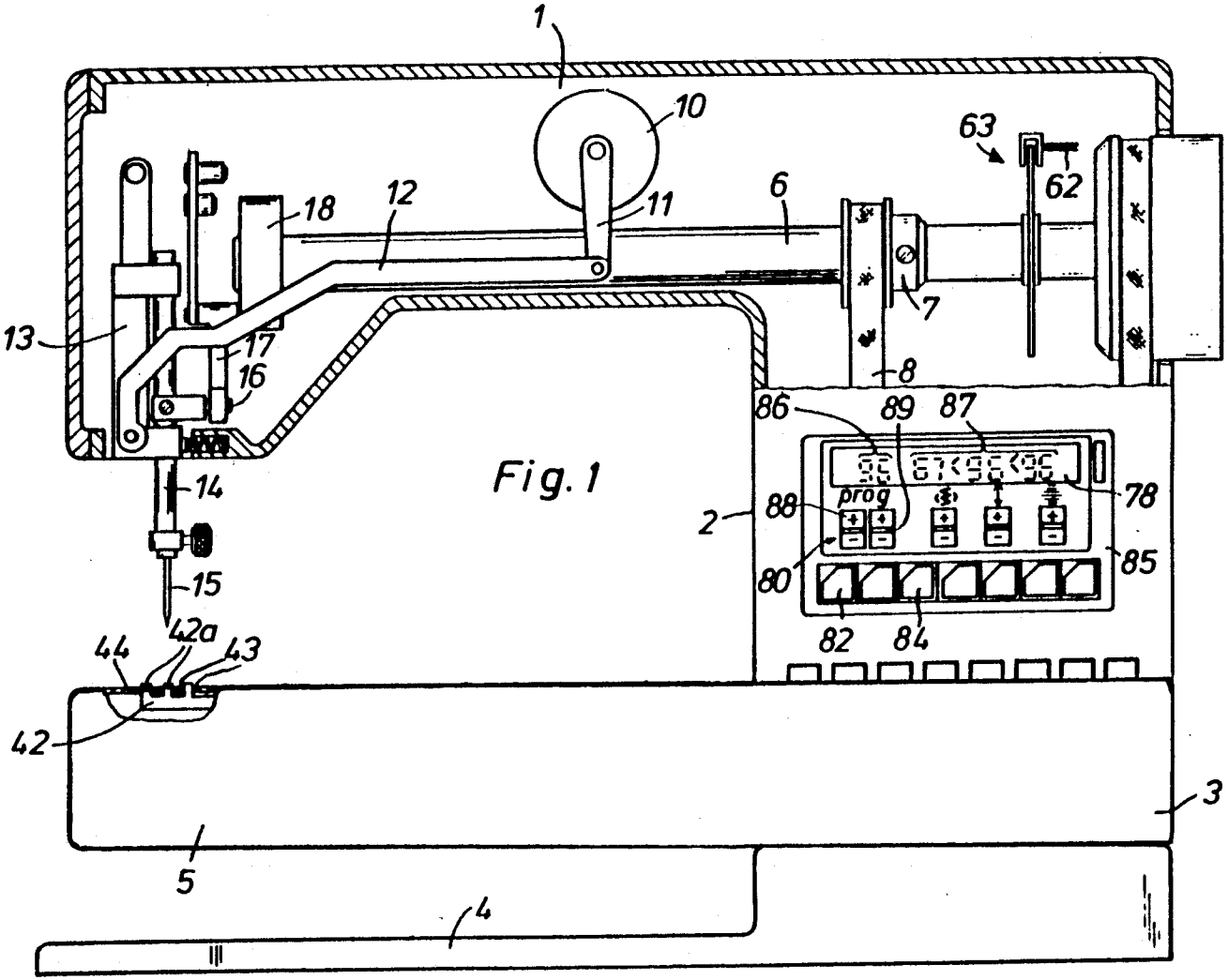
FIG. 1 is a partially sectional view of a sewing machine with electronic control device according to the invention.

The sewing machine shown in FIG. 1 has an arm 1 that is connected to a base 3 via a stand 2. The base 3 is carried by a bottom plate 4 and is expanded in the forward direction compared with the stand 2 and the arm 1. The base is equipped with a fabric support arm 5, which is displaced to the rear in relation to the center line of the base 3, in which the lower stitch-forming tools, especially the looper of the sewing machine, are mounted.

Figure 2:
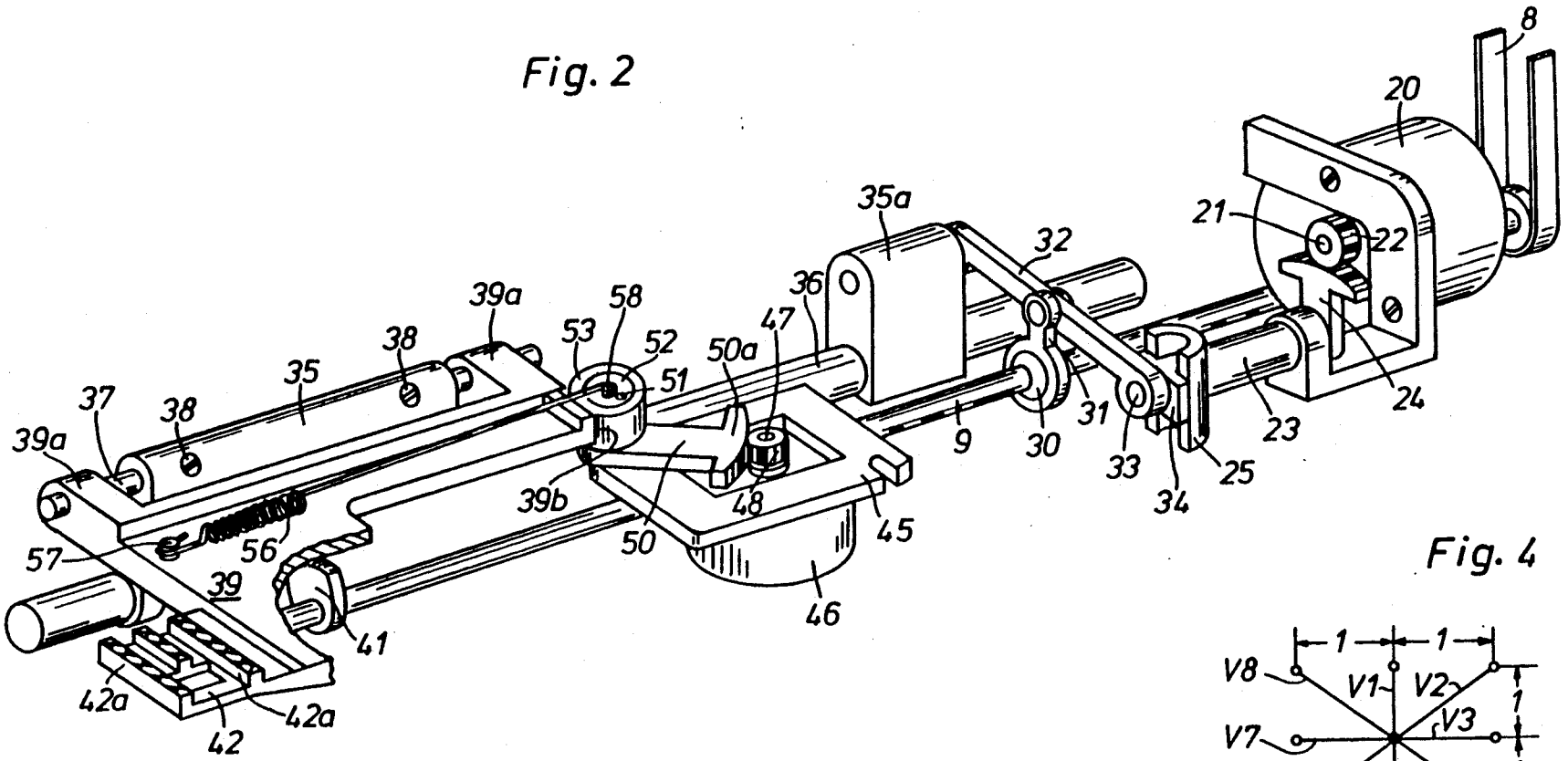
FIG. 2 is an enlarged schematic representation of the drive unit for driving a feed dog according to the invention.

A main shaft 6 mounted in the arm 1 of the sewing machine drives, via a gear 7 and a toothed belt 8, a lower shaft 9 (see A main shaft 6 mounted in the arm 1 of the sewing machine drives, via a gear 7 and a toothed belt 8, a lower shaft 9 (see FIG. 2), which is used to drive the shuttle in the known manner (not shown).

A stepping motor 10, which is connected to a needle bar rocker 13 via a crank 11 and a connecting rod 12, is provided in the arm 1. The needle bar rocker 13 is hinged to a bolt in the arm 1 and carries a vertically movable needle bar 14 with a needle 15. The needle bar 14 is rigidly connected to a pin 16, on which a connecting rod 17 acts, which is hinged to a crank 18 fastened to the main shaft 6.

A stepping motor 20 (see FIG. 2), whose shaft 21 drives a toothed segment 24 fastened on an adjusting shaft 23 via a pinion 22, is fastened in the base 3. A connecting link guide 25 is fastened at the free end of the adjusting shaft 23.

An eccentric 30, which is surrounded by an eccentric rod 31, which is hinged to the middle part of a push rod 32, is fastened on the shaft 9. One end of this push rod 32 is connected via a pin 33 to a sliding block 34, which is mounted rotatably on the pin 33 and cooperates with the connecting link guide 25 in the known manner. The other end of the push rod 32 is connected to a rocker arm 35*a* of a feed rocker 35, which is carried by a shaft 36 mounted in the lower arm 3.

A shaft 37 is fastened by means of screws 38 in a bore of the feed rocker 35. A support 39 is mounted pivotably and displaceably on the shaft 37. The support 39, which is supported on a lifting cam 41 fastened to the shaft 9, is rigidly connected to a feed dog 42.

To feed the fabric to be sewn, the feed dog 42 is provided with feed webs 42*a*, which act on the fabric to be sewn through openings 43 (see FIG. 1) provided in a needle plate 44 covering the fabric support arm 5 in the area of the stitch formation site. The openings 43 are designed such that the feed webs 42*a* of the feed dog 42 are able to perform shifting movements both in the feed direction and at right angles to the feed direction.

A stepping motor 46, on the driving shaft 47 of which a pinion 48 is fastened, is fastened with screws in a plate 45 (FIG. 1) carried by the fabric support arm 5. This pinion 48 is in driving connection with a toothed segment 50*a* of a rocker 50 which is mounted on a pin 51 fastened on the plate 45. A shoulder of the rocker 50 surrounding the pin 51 is designed as an eccentric 52, whose shaft extends outside the shaft of the pin 51. A sleeve 53, against which a lateral surface 39*b* of the support 39 abuts under the effect of a tension spring 56, is rotatably mounted on the eccentric 52. One end of this tension spring 56 is suspended on a pin 57 fastened on the support 39, and its other end is suspended on a bolt 58, which is fastened in the shaft of the eccentric 52.

Figure 3:
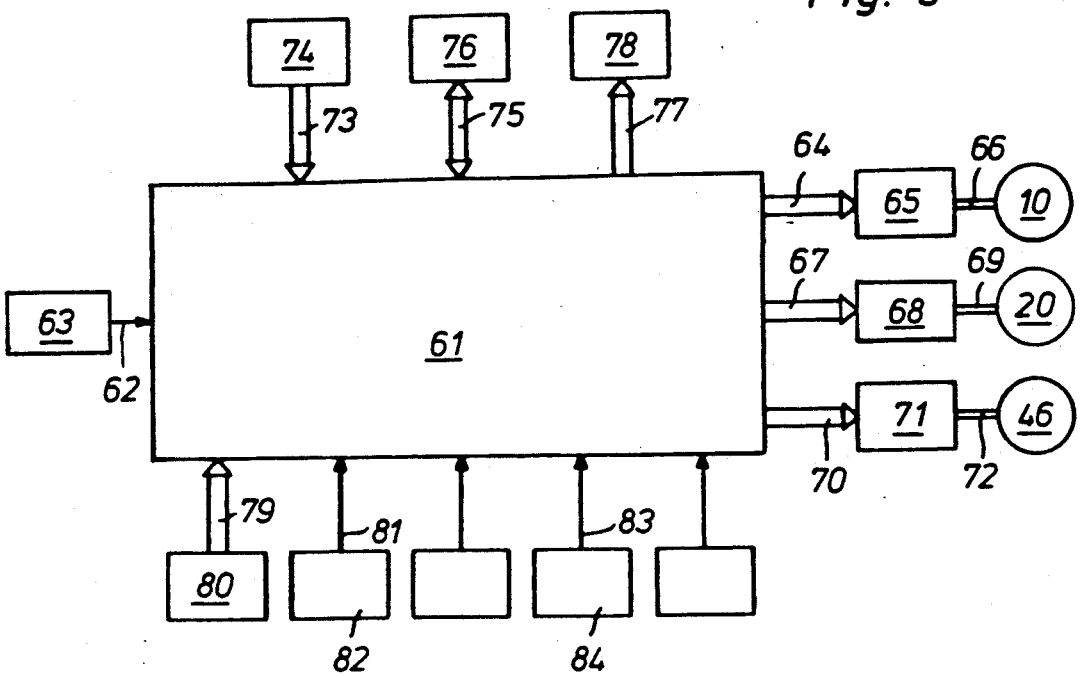
FIG. 3 is a block diagram of a control system of the electronically controlled sewing machine according to the invention.

A microcomputer 61 (FIG. 3), which is connected via lines 62 to a pulse generator 63 driven synchronously by the main shaft 6 of the sewing machine, is accommodated in the housing of the sewing machine. During each revolution of the machine, the pulse generator 63 sends an impulse to the microcomputer 61 when the needle 15 has left the fabric being sewn, and the stepping motor 10 is able to adjust the position of the needle bar; in addition, it also sends a signal when the feed dog 42 has completed its feed movement and the stepping motors 20 and 46 are able to perform the control of a new feed amount. A stitch position control unit 65, which is connected via lines 66 to the stepping motor 10, is connected to the microcomputer 61 via lines 64. Via lines 67, the microcomputer 61 is connected to a forward/reverse feed control unit 68, and the latter is connected to the stepping motor 20 via lines 69. Finally, the microcomputer 61 is connected via lines 70 to a transverse feed control unit 71 for carrying out a cross feed, and this cross feed or transverse feed control unit 71 is connected via lines 72 to the stepping motor 46.

A read-only memory (ROM) 74 is connected to the microcomputer 61 via lines 73, a working memory (RAM) 76 is connected to the microcomputer 61 via lines 75, and a display unit 78 is connected to the microcomputer 61 via lines 77. In addition, a selection unit 80 is connected to the microcomputer 61 via lines 79, a program entry key 82 is connected via line 81, and a repeat key 84 is connected via line 83.

The designs and the general control of the three stepping motors 10, 20, and 46 are identical. The stepping motor 10 is used to control the lateral movement of the guide rocker 13; the stepping motor 20 is used to control the pushing movement of the feed dog in its normal feed direction; and the stepping motor 46 is used to control the displacing movement of the feed dog 42 at right angles to its normal feed direction.

A control panel 85 (FIG. 1) is fastened on the front side of the housing of the sewing machine. A display unit (78) is accommodated in this control panel 85. It consists of a section 86 with two display elements and one section 87 with eleven display elements. The sewing patterns to be selected are displayed by a two-digit number in the section 86. Two rocker switches 88 and 89, which form the selection unit 80, are arranged in the section 86. The right-hand rocker switch 89 is used to switch upward (+) or downward (−) the number formed by the two display elements. The left-hand rocker switch 88 is used to switch the numbers formed with the left-hand display element up (+) or down (−) independently.

The program entry key 82 and the repeat key 84 are arranged under the rocker switches 88 and 89.

The display elements of the display unit 78 are connected via the lines 77 to the microcomputer 61, which is able to connect them to a program memory formed by part of the working memory 76.

The electronic control unit of the sewing machine is designed to be such that the control commands for the stepping motors 10, 20, and 46 of every individual sewing pattern are stored in coded form as control segments in the read-only memory 74 of the microprocessor 61, and can be entered from there into the program memory contained in the working memory 76 in a desired sequence on the basis of the pattern number.

To select a desired combination of individual sewing patterns, the decimal number associated with the first individual sewing pattern, which number is taken from a table, is set in the display elements of the section 86 of the display unit 78 by means of the two rocker switches 88 and 89. Immediately after the setting process, the basic data corresponding to the individual sewing pattern selected are taken over by the microcomputer 61 from the read-only memory 74 into the working memory 76. When the program entry key 82 is actuated, this pattern number is entered into the program memory part of the working memory 76. Further individual sewing patterns can also be called from the read-only memory 74 in the same manner, and stored in the program memory part by means of the program entry key 82. It is thus possible to store sewing sequences containing an arbitrary sequence of individual sewing patterns.

After completion of the data entry, the machine is switched over to the "Sewing of the sewing patterns stored" mode by means of the repeat key 84, and the contents of the pattern numbers stored are displaced at the same time by the section 87 of the display unit 78.

During sewing, the coded control data of the corresponding individual sewing patterns contained in the control unit are consecutively called in the known manner each time after a pattern number is called by the microcomputer 61. The microcomputer 61 now controls the stepping motor 10 for the lateral rocking movements of the guide rocker 13 via the stitch position control unit 65, the stepping motor 20 for the normal feed movement of the feed dog 42 via the forward-/reverse feed control unit 68, as well as the stepping motor 46 for the transverse movement of the feed dog 42 via the cross feed control unit 71, corresponding to the programed sequence, which is then repeated.

To perform the stitch formation, the stepping motor 10 pivots the guide rocker 13 into the new stitch position for the needle 15 via the crank 11 and the connecting rod 12, as soon as the needle has left the fabric being sewn. The stepping motor 20 will adjust the connecting link guide 25 via the pinion 22 and the toothed segment 24. During the swinging-out movement of the bolt 33 brought about by the eccentric rod 31, the sliding block 34 is pushed to and from in the connecting link guide 25. Corresponding to the angular position of the connecting link guide 25, which is imposed on it by the stepping motor 20, the sliding block 34 will pivot the feed rocker 35 via the push rod 32, thus imparting to the feed dog 42 feed movements, whose amount and direction depend on the angular position of the connecting link guide 25.

Synchronously with the rotation of the main shaft 6, the lifting cam 41 is driven via the shaft 9, and imparts lifting movements to the feed dog 42.

To displace the fabric being sewn at right angles to the normal fabric feed, the stepping motor 46 drives the rocker 50 via the pinion 48, as a result of which the eccentric 52 will laterally displace the support 39 against the action of the tension spring 56 via the sleeve 53. The feed webs 42*a* of the fed dog 42 connected to it will now carry the material to be sewn at right angles to the normal feed direction during their lateral displacement. This displacement takes place synchronously with the normal feed movement of the feed dog 42, i.e., during the phase in which the feed webs 42*a* of the feed dog 42 are raised above the needle plate 44.

Besides a great number of sewing patterns consisting of a plurality of individual stitches, whose individual stitches are produced from combinations of the lateral oscillation of the needle and the feed of the material being sewn in the feed direction or simultaneously in the feed direction and at right angles to the feed direction, the read-only memory 74 also contains so-called offset stitches. These offset stitches consist of 8 individually selectable individual stitches V1 through V8 (FIG. 4), whose feed in the normal feed direction is zero or 1 mm forward or backward, and whose feed in the transverse direction is also zero or 1 mm to the right or left. Thus, there are two individual stitches V1 and V5 in the normal feed direction and opposite the normal feed direction; two individual stitches V3 and V7 at right angles to the normal feed direction; as well as four individual stitches V2, V4, V6, and V8, which latter are produced by a combination of the drive of the feed dog 42 in the normal feed direction and at right angles to this [direction]. The respective individual stitch and the fabric feed needed for it correspond to the line connecting a first needle touchdown point (filled circle in FIG. 4) to a second needle touchdown point (one of the empty circles in FIG. 4).

Figure 5:
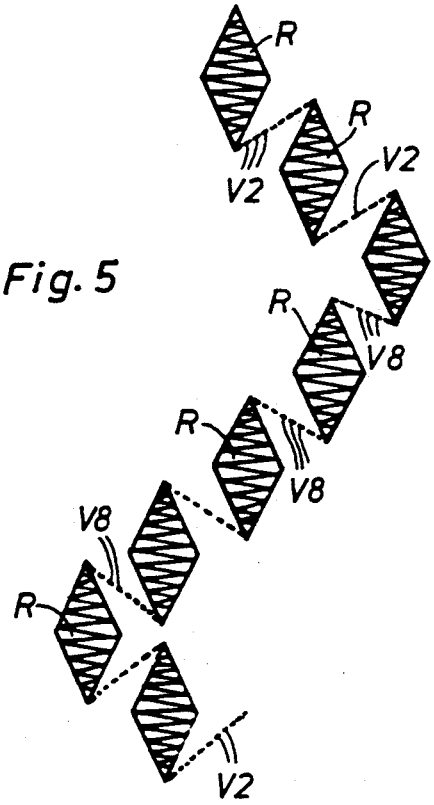
FIGS. 5 and 6 show schematic representations of combination patterns according to the present invention.

By combining one or more of the normal individual sewing patterns being stored in the read-only memory 74, e.g., a lozenge pattern R, with a number of offset stitches, e.g., 10 individual stitches V2 and V8, it is possible to produce, as is shown in FIG. 5, a very broad combination pattern, without this combination pattern having to be stored in the read-only memory 74.

The combination pattern shown in FIG. 5 is composed by consecutively programing the lozenge pattern R and the individual stitches V2 or V8. To do so, the number 64, which corresponds to the lozenge pattern R, is set in the section 86 of the display unit 78 by means of the selection unit 80, after which it is entered into the working memory 76 by means of the program entry key 82. The number 92, which corresponds to the individual stitch V2, is subsequently set analogously in the section 86, and 10 of these individual stitches V2 are entered into the working memory 76 by depressing the program entry key 82 ten times. This is followed by another insertion of the lozenge pattern R with subsequent entry of new individual stitches V2, etc., until the entire program sequence of the combination pattern has been set up. After subsequently actuating the repeat key 84, the programed combination pattern can then be sewn.

Figure 6:
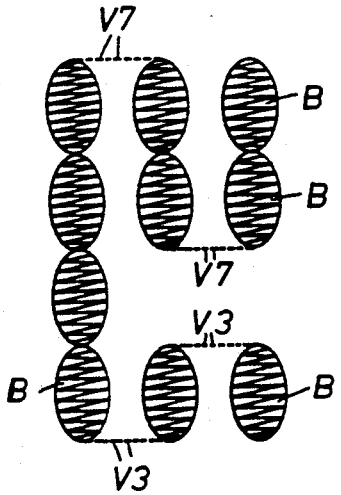

The other combination pattern represented as an embodiment in FIG. 6 is composed by consecutively programing the arc-shaped pattern B and the individual stitches V7 and V3 analogously to the above-described combination pattern.

By directed entry of the individual stitches V1 through V8 together with the individual sewing patterns present in the read-only memory, it is thus possible to produce combination patterns of any desired length, and the combination patterns can be formed either from a sequence of the same individual sewing pattern, which sequence is connected by individual stitches, or from a sequence of different individual sewing patterns.

Figure 4:
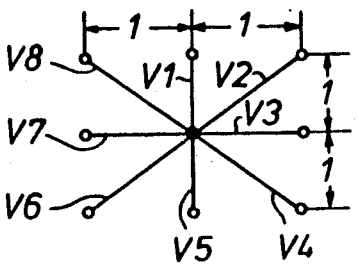
FIG. 4 is a greatly enlarged representation of the direction and the stitch length of the individual stitches being stored.

The preparation of the individual stitches is not limited, of course, to the stitch length and direction of preparation shown as an example in FIG. 4.

While a specific embodiment of the invention has been shown and described in detail to illustrate the application of the principles of the invention, it will be understood that the invention may be embodied otherwise without departing from such principles.

What is claimed is:

1. A process for producing combination sewing patterns including a plurality of individual sewing patterns by means of an electronically controlled sewing machine, which has a feed mechanism for driving a feed dog for transporting fabric to be sewn in a primary feed direction as well as at right angles to the primary feed direction, and a drive for a needle bar rocker for deflecting the needle bar rocker at right angles to the normal feed direction during a feed pause of the feed dog, a memory for storing a great variety of individual sewing patterns, as well as for a plurality of individual stitches with different feed directions, wherein at least one individual stitch is made in a selectable manner between a formation of a last touchdown of a first individual sewing pattern and a formation of a first touchdown of a second individual sewing pattern, the process comprising the steps of:

inserting at least one individual stitch in a selectable manner between the formation of a last needle touchdown of a first individual sewing pattern and the formation of a first needle touchdown of a second individual sewing pattern; and feeding the fabric to be sewn at least partially at right angles with respect to the normal feed direction after a predeterminable number of individual stitches for preparing a combination pattern exceeding a normal stitch field width of an individual sewing pattern, said feeding the fabric being performed exclusively by the feed dog.

2. A process according to claim 1, wherein a sum of said individual stitches are formed by feeding the fabric to be sewn both in said normal feed direction and in said direction at right angles to said normal feed direction.

3. A process for producing combination sewing patterns, the process comprising the steps of:

providing an electronically controlled sewing machine with a feed mechanism for driving a feed dog for transporting fabric to be sewn in a normal feed direction as well as in a direction at right angles to said normal feed direction; providing a drive for a needle bar rocker for deflecting said needle bar rocker at right angles to a normal feed direction during a feed pause of said feed dog; providing a memory for a great variety of individual sewing patterns and for a plurality of individual stitches with different feed directions; forming an individual stitch in a selectable manner between a formation of a last touchdown of a first individual sewing pattern and a formation of a first touchdown of a second individual sewing pattern and preparing a combination pattern exceeding a normal stitch field width of an individual sewing pattern by transporting the fabric to be sewn exclusively by said feed dog, said transporting being carried out during the formation of a predeterminable number of individual stitches which are inserted between two individual sewing patterns, said transporting being at least partly at right angles to said normal feed direction.

4. A process according to claim 1, wherein said first individual sewing pattern and said second individual sewing pattern comprise a two-dimensional zigzag filling pattern including a border with a zigzag stitch filling prepared by several intermediate stitches in lateral repetition.

5. A process according to claim 3, wherein said first individual sewing pattern and said second individual sewing pattern comprise a two-dimensional zigzag filling pattern including a border with a zigzag stitch filling prepared by several intermediate stitches in lateral repetition.

6. A process according to claim 1, wherein said intermediate stitches comprising said zigzag stitch filling are formed by deflection of said needle rocker, corresponding to a width of the two dimensional zigzag filling pattern, and movement of said feed dog in the normal direction corresponding to a length of the two dimensional zigzag filling pattern.

7. A process according to claim 3 wherein said intermediate stitches comprising said zigzag stitch filling are formed by deflection of said needle rocker, corresponding to a width of the two dimensional zigzag filling pattern, and movement of said feed dog in the normal direction corresponding to a length of the two dimensional zigzag filling pattern.

* * * * *